US005669816A

United States Patent [19]

Garczynski et al.

[11] Patent Number: 5,669,816

[45] Date of Patent: Sep. 23, 1997

[54] BLACKJACK SCANNER APPARATUS AND METHOD

[75] Inventors: John S. Garczynski, Norristown; John J. Dobson, Oreland, both of Pa.

[73] Assignee: Peripheral Dynamics, Inc., Plymouth Meeting, Pa.

[21] Appl. No.: 687,245

[22] Filed: Jul. 25, 1996

Related U.S. Application Data

[63] Continuation-in-part of Ser. No. 496,355, Jun. 29, 1995, Pat. No. 5,632,483.

[51] Int. Cl.[6] ..... A63F 1/14

[52] U.S. Cl. ..... 463/12; 463/29; 273/148 R; 273/149 R; 273/148 A

[58] Field of Search ..... 273/149 P, 149 R, 273/309, 148 R, 148 A; 463/12, 29, 46

[56] References Cited

U.S. PATENT DOCUMENTS

| | | | |
|---|---|---|---|
| 4,531,187 | 7/1985 | Uhland | 364/412 |
| 4,822,050 | 4/1989 | Normand et al. | 273/149 P |
| 5,039,102 | 8/1991 | Miller | 273/148 R |
| 5,110,134 | 5/1992 | Laughlin et al. | 273/293 |
| 5,219,172 | 6/1993 | Laughlin et al. | 273/304 |
| 5,224,712 | 7/1993 | Laughlin et al. | 273/304 |
| 5,312,104 | 5/1994 | Miller | 273/148 R |
| 5,374,061 | 12/1994 | Albrecht | 273/149 R |
| 5,397,133 | 3/1995 | Penzias | 273/149 P |
| 5,431,399 | 7/1995 | Kelley | 273/149 P |
| 5,451,054 | 9/1995 | Orenstein | 273/309 |

*Primary Examiner*—Benjamin H. Layno

*Attorney, Agent, or Firm*—Woodcock Washburn Kurtz Mackiewicz & Norris LLP

[57] ABSTRACT

A module for announcing when a Dealer has blackjack without exposing the face of the Dealer's down-card. The module scans a character from the Dealer's face-down standard playing card, compares the result of the scan with a set of references, and identifies the down-card. The module also receives input from the Dealer as to the identity of the Dealer's up-card, and announces whether the Dealer has blackjack or the hand continues. The module is designed to be mounted to a blackjack table such that the surface of the module on which the standard playing card rests while being scanned is in the plane of the surface of the blackjack table, allowing the Dealer to slide the down-card across the table and onto the scanner without lifting, and potentially exposing, the card's face. The module also removes the noise generated by a casino's heat, dust, cigarette and cigar ashes, and lint from the felt of the blackjack table, during the scanning process. The module further optimizes the scan of the character on the standard playing card by controlling the light intensity emitted by the components of the module used to illuminate the character.

18 Claims, 8 Drawing Sheets

BLACKJACK SCANNER APPARATUS AND METHOD

This application is a continuation-in-part application to the patent application, Ser. No. 08/496,355, filed in the United States Patent Office on Jun. 29, 1995, now the U.S. Pat. No. 5,632,483, disclosure of which is hereby incorporated by reference as if set forth fully herein.

BACKGROUND OF THE INVENTION

1. Field of the Invention

The present invention relates to card scanners, and more particularly, to a card scanner which is used by a blackjack Dealer to determine if the Dealer has "blackjack" prior to continuing to deal to the other players.

2. Description of the Prior Art

Blackjack is a card game often played in casinos. The game is played by a Dealer dealing a hand of two cards face-up to every player and one card face-up and one card face-down to himself or herself. Each card has an associated value identified by the patterns and characters on the card. A card with a numerical character has a value equal to that of the number on the card. A card with a "J," "Q," or "K" character has a value of ten. A card with an "A" character has a value of one or eleven (for the purposes of the invention, "A" cards have a value of eleven). If the value of the Dealer's hand totals twenty-one with his first two cards, he has "blackjack" and wins. Another way to express it is if the Dealer's hand is an Ace and either a 10, Jack, Queen, or King, the Dealer has blackjack. Traditionally, the Dealer determines the value of the down-card by "peeking" at it. If the Dealer does not have "blackjack," the game continues. If the Dealer has "blackjack" he or she wins and the other players do not play out their hands and a new game can start immediately.

To insure against security breaches and resulting loss of revenue, casinos instituted a "no peek" rule that prevents Dealers from peeking at their down-card. An unscrupulous Dealer can peek at the down-card to provide an accomplice with the value of the Dealer's cards. With that knowledge, the accomplice makes a more informed gambling decision when playing out his or her hand. This informed gambling decision significantly tilts the odds of winning away from the casino. With the odds tilted away from the casino, the casino loses potential revenue.

The blackjack game is significantly slowed by the "no peek" rule, which costs the casino revenue. The more games of blackjack played, the more potential revenue for the casino. With the "no peek" rule, every player in every game plays out his or her hand. Obviously, this is true for when the Dealer is dealt "blackjack" initially. Therefore, when the Dealer does get "blackjack" initially, the game continues longer than necessary, lowering the number of games of blackjack played at a table. Since a casino's revenue is directly proportional to the number of games of blackjack played, casinos lose potential revenue when less games are played.

Since certain casinos established the "no peek" rule more than a decade ago, they have been searching for a way for a Dealer to know if he or she is initially dealt "blackjack" without breaching security. One possible avenue identified is a device that notifies the Dealer when he or she has "blackjack" without the Dealer lifting any part of the down-card off the surface of the blackjack table. People have laid out numerous paths to achieve the desired target. Unfortunately, each path attempted leaves unaddressed certain concerns of the casinos.

One partially successful route followed by those seeking a solution involved marked cards and a mark sensor mounted in the surface of the playing table. As disclosed in U.S. Pat. Nos. 5,110,134 5,219,172, and 5,224,712 to Laughlin et al., a card mark sensor is mounted in the surface of the playing table. This allows the Dealer to slide the down-card onto the sensor without lifting any portion of the card. However, this route is only partially successful because standard blackjack cards cannot be used. This invention requires the cards to be specially marked with either a photoelectrically detectable mark, a magnetic mark, a light-polarizing mark, or something similar. The required use of specially marked cards instead of standard playing cards compels further development of a more acceptable solution.

Another route prescribed by U.S. Pat. No. 5,312,104 to Miller involves the use of a bar code reader and bar code marked cards. As this design requires marked cards, it leaves unaddressed the same concerns as the Laughlin patents.

Another partially successful route laid out by U.S. Pat. No. 5,039,102 to Miller describes the use of a mirror arranged such that the Dealer can view a reflected image of a portion of the face of the down-card. The Dealer slides the down-card over a first viewport in the surface of the table. A mirror mounted under the first viewport reflects the down-card's image up through a second viewport in the table. This image is visible only to the Dealer. Again, this patent specifically calls for the use of marked cards, still leaving some casino's concerns unaddressed. A further limitation of this route is that the Dealer has to be within a certain height range to view the card image through the second viewport.

One attempt to use standardized blackjack cards did not stand up to the rigors of the casino environment. This attempt utilized an optical reader that looked at eight points on a standard "Bee" brand play card. The point locations were such that theoretically the playing cards could be identified just from comparing these eight points. However, due to dust and lint on the cards and changes in room temperature, this attempt resulted in a device that required excessive adjustments and calibrations. These restrictions limited the usefulness of this approach.

Another attempt to use standardized blackjack cards involved the use of a video camera and screen. However, the costs involved with this type of equipment makes this approach expensive. Further, since the Dealer would know the value of the card, security against unethical Dealers is a problem also. The security aspect could be alleviated to a certain extent by using marked cards, as disclosed in U.S. Pat. No. 5,312,104 to Miller, but then the concerns of using marked cards surfaces.

It is clear that there has existed a long and unfilled need in the prior art for a device to reliably announce if a blackjack Dealer is initially dealt "blackjack" without the Dealer knowing the value of his or her down-card, without the use of a specially marked deck of cards, and in an economically viable way.

SUMMARY OF THE INVENTION

Accordingly, it is an object of the invention to provide a "blackjack" announcing device for blackjack that allows for the use of standard playing cards.

It is further an object of the invention to provide a "blackjack" announcing device that scans at least a portion of a character of a face-down standard playing card into an array and stores the result of the scan in memory.

It is further an object of the invention to provide a "blackjack" announcing device that compares the stored scan result to a set of references representing possible results of a scan and identifies the scanned standard playing card.

It is yet further an object of the invention to provide a "blackjack" announcing device for blackjack that allows inputting of the identity of the Dealer's up-card and determines if the Dealer's hand is blackjack.

It is still a further object of the invention to negate the effects of a casino environment, the heat, the dust, the ashes, and the lint from the felt playing tables, on the device used to scan the standard playing cards.

In order to achieve the above and other objectives of the invention, there is provided a card scanner for use with standard, unmarked cards that allows a Dealer to slide his or her down-card onto a card scanner that is mounted substantially flush with the surface of the blackjack table, the card scanner recognizes the value of the down-card, compares it to the value of the Dealer's up-card, and announces if the Dealer has won or if the hand continues. By sliding the card onto the card scanner, the face of the down-card is not exposed, preventing the Dealer from cheating a casino by providing to an accomplice the identity of the Dealer's hand. The card scanner recognizes the identity of the down-card by scanning a symbol on the card and comparing the result of the scan with a set of references. The card scanner knows the identity of the up-card by direct input. The card scanner then determines if the Dealer has blackjack or if the deal continues.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
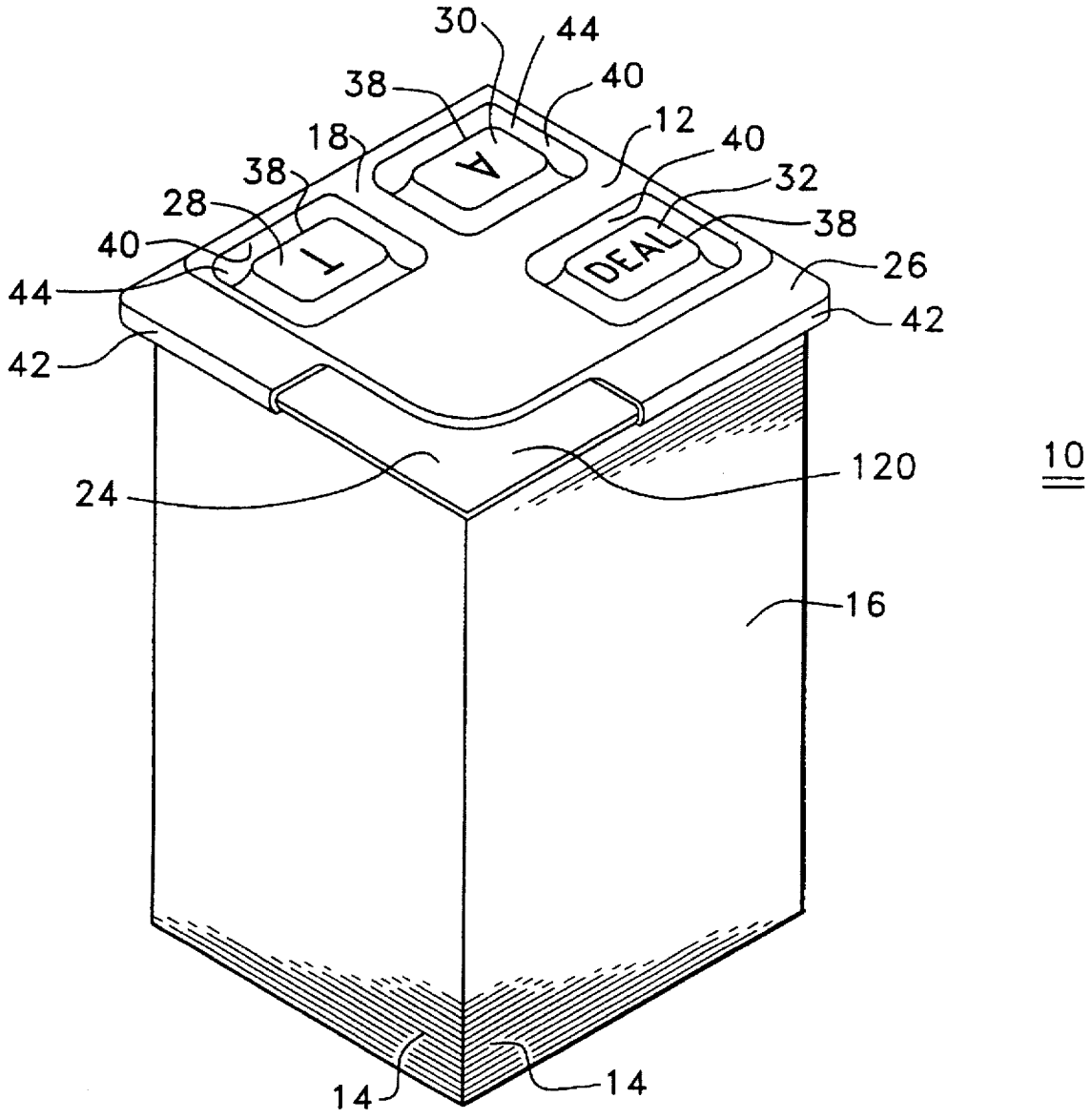
FIG. 1 shows an isometric view from the top of the scanning module.

Referring now to the drawings, FIG. 1 shows a scanning module 10 seen isometrically from above. Scanning module 10 is of a rectangular block shape with a top surface 12, four side surfaces 14 (only two are shown), and a bottom surface (not shown). The top surface 12 is the upper most surface of the scanning module as shown in FIG. 1. The top surface 12 is substantially square while the four side surfaces 14 are substantially rectangular.

Scanning module 10 is comprised of a housing 16 and a top plate assembly 18. Housing 16 is a rectangular, hollow block or can with an open top side (not shown). Housing 16 defines the four side surfaces 14 and the bottom surface (not shown). Top plate assembly 18 defines the top surface 12 of scanning module 10 and covers the open side. Top plate assembly 18 is snugly attached to housing 16 in such a manner as to prevent dust from entering scanning module 10 where housing 16 abuts top plate assembly 18.

Figure 2:
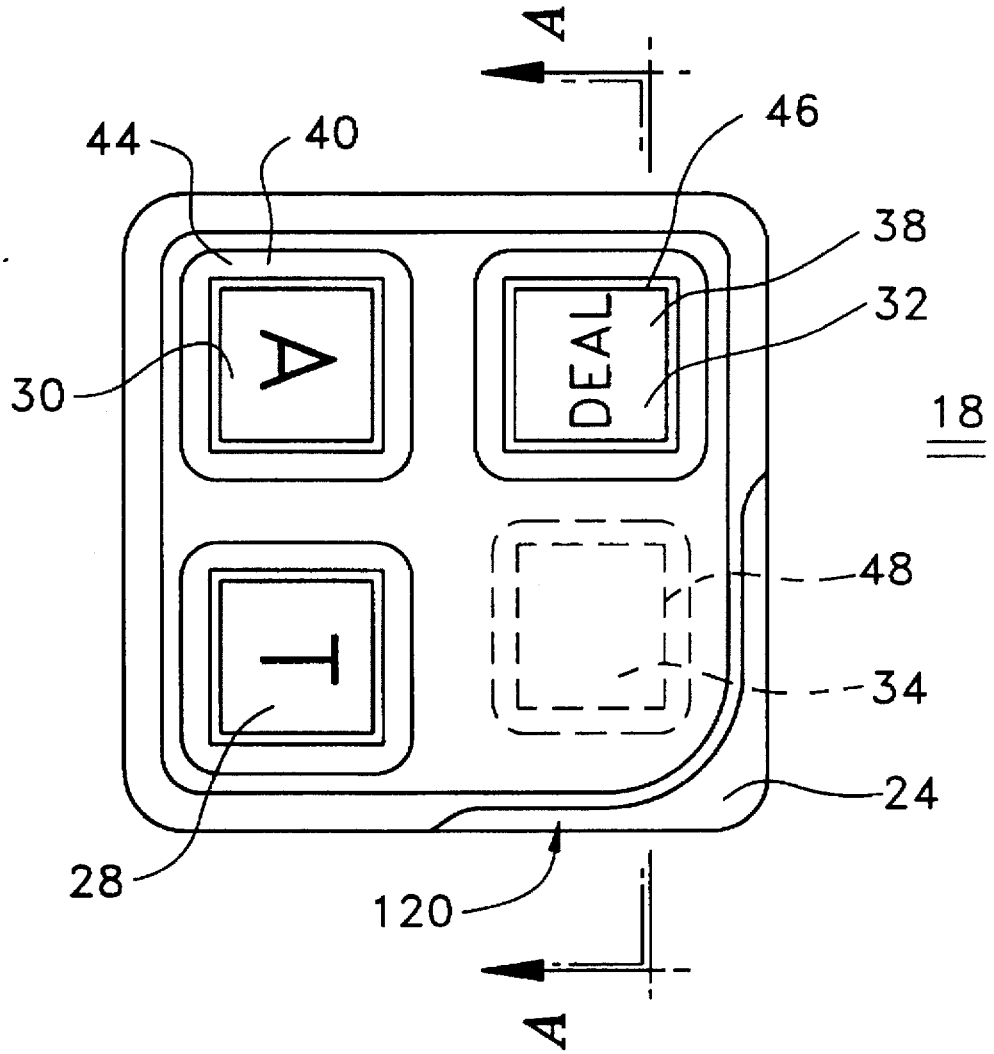
FIG. 2 shows a top view of the scanning module.
Figure 3:
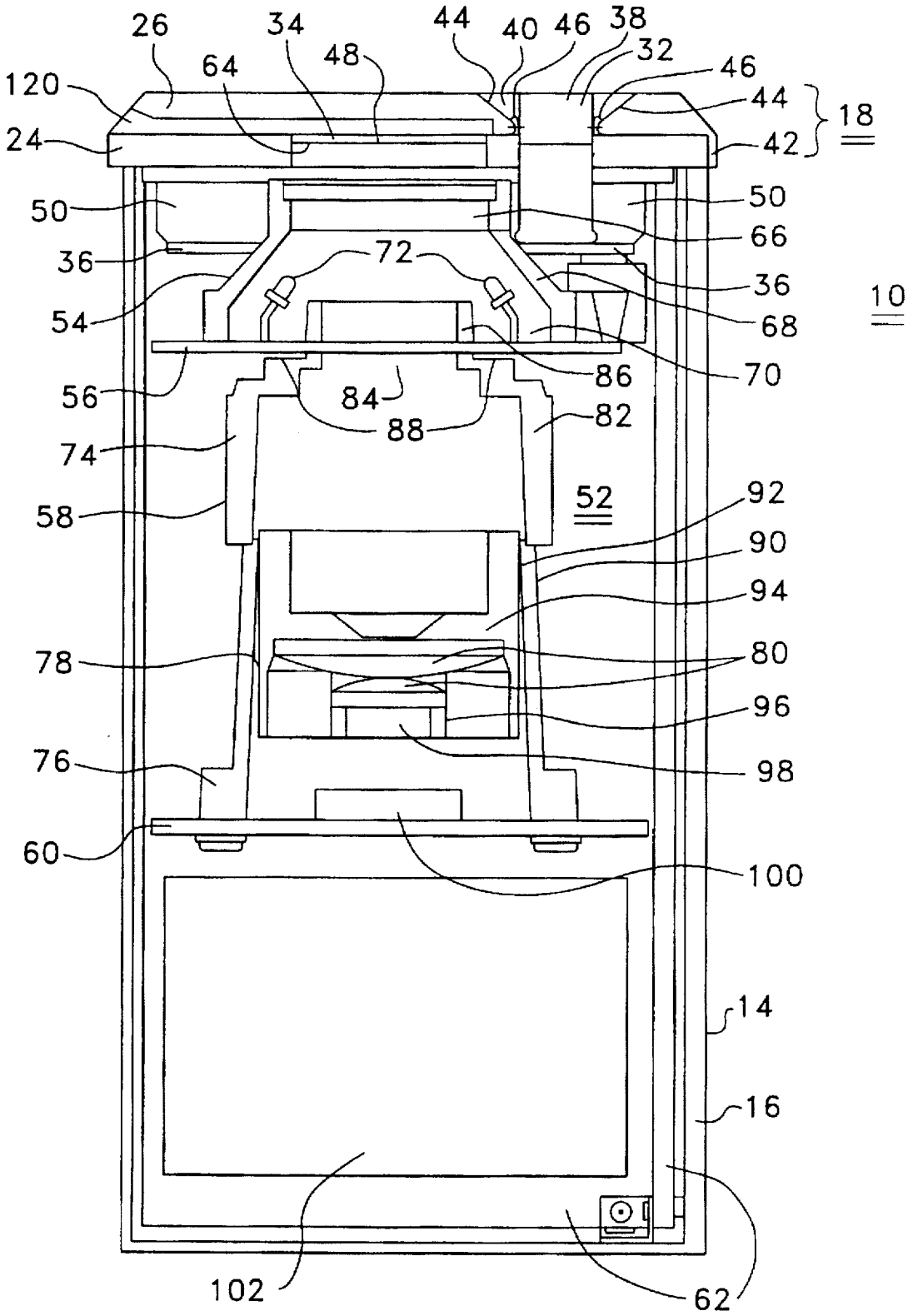
FIG. 3 shows a sectional elevation view of the scanning module.

Referring also to FIGS. 2 and 3, top plate assembly 18 of the invention is comprised of a base 24, a shield 26, a "T" switch 28, an "A" switch 30, a "DEAL" switch 32, a glass cover plate 34 (see FIG. 2), and a switches' circuit board 36 (see FIG. 3). During the operation of scanning module 10, switches 28, 30, and 32 are used by the Dealer to input the value of the Dealer's up-card and start the scanning process (by the Dealer depressing the appropriate switch) and to visually announce if the Dealer has blackjack (by becoming illuminated) without directly announcing the value of the Dealer's down-card. If the up-card is a card with a value of 10, the Dealer depresses "T" switch 28. If the up-card is an ace, the Dealer depresses "A" switch 30. If the Dealer does not have blackjack, scanning module 10 announces a continuation of the hand by illuminating the LED (not shown) in "DEAL" switch 32, which in turn illuminates the switch. If "A" switch 30 is depressed and the down-card is a 10, J, Q, or K, then the Dealer has blackjack and scanning module 10 announces this by illuminating the LED (not shown) in "T" switch 28, which in turn illuminates the switch. If "T" switch is depressed and the down-card is an ace, then the Dealer has blackjack and scanning module 10 announces this by illuminating the LED (not shown) in "A" switch 30, which in turn illuminates the switch. This is discussed in greater detail below. Switches 28, 30, and 32 are assembled so as to inhibit dust from entering scanning module 10 through or around the switch. To accomplish this, switch cap 38, the portion of the switch that is depressed, and collar 46 (FIG. 2) of the switch, which rests on shield 26 and through which switch cap 38 travels when depressed, have a snug fit. Each of the switches and the glass cover plate is located in its own corner of top plate assembly 18.

Observing FIG. 1, "A" switch 30 is located in the uppermost corner of top plate assembly 18. "T" switch 28 is located in the left-most corner of top plate assembly 18. "DEAL" switch 32 is located in the right-most corner of top plate assembly 18. Glass cover plate 34 is located in the bottommost corner of top plate assembly 18 (see FIG. 3). To activate a function of scanning module 10, switch cap 38 of either switch 28 or 30 is depressed. Each switch cap 38 is located in a recess 40 in shield 26 such that the switch caps do not protrude above the plane formed by the top of shield 26. Each switch cap 38 is illuminated by its own LED (not shown) to either indicate that the switch is depressed or make an announcement subsequent to a function of scanning module 10.

Lip 42, which extends below the perimeter of shield 26, is in contact with base 24. Lip 42 wraps around the perimeter of shield 26 except for the perimeter adjacent to the bottommost corner of top plate assembly 18 as shown in FIG. 1. Lip 42 is not present at that corner, forming card insertion slot 120, because this is where at least one playing card is inserted face-down and read by scanning module 10. In the preferred embodiment of the process for determining if the Dealer has blackjack, the Dealer places his/her up-card on top of his/her down-card and slides the two cards into card insertion slot 120 (see FIG. 5). Since the playing card is inserted in slot 120 face-down, or, more accurately, slid face-down across the surface of the blackjack table (not shown) and into card insertion slot 120, the Dealer cannot read the value of the down-card. By the Dealer not reading the down-card, the opportunity for cheating the casino is decreased as described above. Shield 26 has three square recesses 40, each with a recessed chamfered edge 44. Collars 46 and recessed chamfered edges 44 are designed and arranged such that the collars of each switch slightly overlap the top of its respective recessed chamfered edge 44. This overlap is to inhibit dust from entering scanning module 10 around the switches.

Referring to FIG. 2, glass cover plate 34 covers scanner view opening 48 (designated by dashed lines). Scanner view opening 48 is essentially rectangular in shape and sized to accommodate scanning the pattern representing the value of a playing card. In the preferred embodiment, the scanned pattern are the characters 2, 3, 4, 5, 6, 7, 8, 9, 10, J, Q, K, and A. However, other embodiments of the invention could scan a portion of the character or at least a portion of the symbol in the center of the face of a standard playing card. It is understood that standard playing cards are cards commercially available and without any special or extra markings which pertain to identifying the playing card. Glass cover plate 34 and scanner view opening 48 are designed and arranged to inhibit dust from entering scanning module 10 through the opening 48.

Now referring to FIG. 3, a sectional view of scanning module 10 taken along section A—A of FIG. 2. is shown. Uppermost in FIG. 3. is top plate assembly 18. Base 24 of top plate assembly 18 has an apron 50 which extends down and is located in from the outer edge of base 24. Adjacent continuously to the lower edge of apron 50 is switches' circuit board 36. On the upper surface of switches' circuit board 36 are mounted switches 28, 30, and 32 (not shown).

Array chip module 52 is located beneath scanner view opening 48 of base 24 and continues down into the interior of housing 16. Array chip module 52 is comprised of a top housing 54, a LED circuit board 56, an optical lens housing 58, an array chip circuit board 60, and two processing and memory storage circuit boards 62. The components of array chip module 52 are roughly arranged such that top housing 54, LED circuit board 56, optical lens housing 58, and array chip circuit board 60 are located below each other respectively and the processing and memory storage circuit boards 62 are at right angles to each other and adjacent to the other components. Further, array chip module 52 is designed and arranged to reside in housing 16 when scanning module 10 is assembled.

Top housing 54 is a hollow, vertical sleeve with a top opening 64, a top section 66, an expansion section 68, and a bottom opening 70. The top opening 64 is sized to accommodate scanner view opening 48. When scanning module 10 is assembled, top section 66 extends through switches' circuit board 36, allowing the top opening 64 be continuous with base 24 while accommodating scanner view opening 48. This prohibits dust from entering the array chip module 52 between top housing 54 and base 24. Top section 66 of top housing 54 extends down from base 24 to switches' circuit board 36. Expansion section 68 is located adjacent to and below switches' circuit board 36.

LED circuit board 56 is horizontally positioned adjacent to top housing 54 and abuts its bottom opening. Bottom opening 70 is continuous with LED circuit board 56 to inhibit dust from entering array module 52 between top housing 54 and LED circuit board 56. Four array module LEDs 72 (only two are visible) are mounted to the top of LED circuit board 56 and are located inside top section 54. Array module LEDs 72 are the light source used to illuminate the playing card being scanned (not shown, see FIG. 5). Array module LEDs 72 are positioned such that they do not block array chip 100 from receiving the image of the character of a scanned playing card.

Optical lens housing 58 is located below LED circuit board 56. Optical lens housing 58 comprises an upper sleeve section 74, a lower sleeve section 76, lens barrel 78, and lenses 80. Upper sleeve section 74 and lower sleeve section 76 are vertically aligned such that each's main axis is not only concurrent with each other, but with the main axis of top section 54 as well. Upper sleeve section 74 is a substantially square sleeve with a vertical wall 82 and a narrow top opening 84. A rim 86 extends up from narrow top opening 84. A top surface 88 extends from the narrow top opening 84 to vertical wall 82 of upper sleeve section 74. Upper sleeve section 74 is attached to the bottom of LED circuit board 56 such that rim 86 extends through LED circuit board 56 and top surface 88 abuts continuously the bottom of LED circuit board 56 to inhibit dust from entering array module 52 in between the two components. Lower sleeve section 76's vertical wall 90 has substantially the same cross-sectional area perpendicular to the main axis as does upper sleeve 74. The top edge of vertical wall 90 abuts the lower edge of wall 82 continuously to inhibit dust from entering array module 52 in between the two components.

Lens barrel 78 is another sleeve shaped device which holds lenses 80. It is slidable mounted inside upper and lower sleeve sections 74 and 76. Lens barrel 78 is comprised of barrel 92 with an internal latitudinal ridge 94, and a plug 96. Lenses 80 reside in barrel 92 and they are oriented perpendicular to the main axis of the upper and lower sleeve sections 74 and 76. Lenses 80 are maintained in a static position in barrel 92 with an adhesive to secure one lens to ridge 94 and the other lens to plug 96. Plug 96 has a hole 98 bored through it, allowing the image of the character of a playing card to be scanned by the array chip 100. Lenses 80 are chosen and arranged to facilitate projecting the character of the playing card onto array chip 100. Lens barrel 78 is movably mounted within upper and lower sleeve sections 74 and 76 to also facilitate adjusting the focus of the image projected onto array chip 100.

Array chip circuit board 60 is attached to the bottom edge of lower sleeve 76 in a horizontal position. Bottom edge of lower sleeve 76 is continuous to array chip circuit board 60 to inhibit dust from entering array module 52 between lower sleeve section 76 and array chip circuit board 60. Array chip 100 is mounted on the top surface of array circuit board 60 and is located within lower sleeve section 76. Array chip 100 in the instant embodiment is comprised of a 14 by 41 array, however, other array chips can be used.

The components of array module 52 and base 24 are designed and arranged to allow the character of a playing card being scanned to be projected onto array chip 100. Array module 52 is located within housing 16 when top plate assembly 18 is attached to housing 16. Scanning module 10 can be powered by an internal battery 102, as shown in FIG. 3, or by an external power source (not shown).

Figure 4:
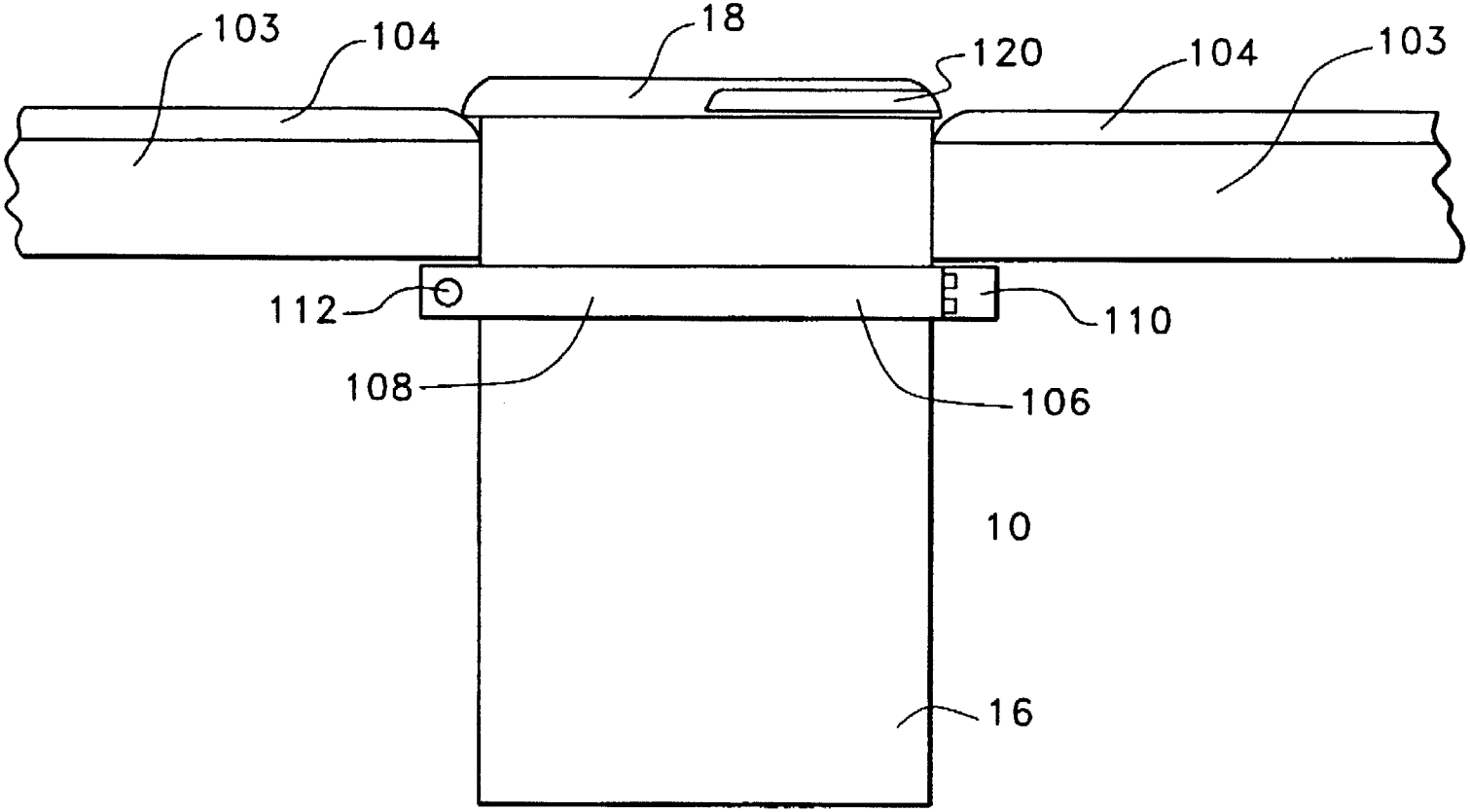
FIG. 4 shows a sectional elevation view of the scanning module mounted in blackjack table.

FIG. 4 shows scanning module 10 mounted to blackjack table 103 with a felt surface 104. Top plate assembly 18 is positioned in felt surface 104 to allow a Dealer to slide a card across the felt surface 104 and into card insertion slot 120 of top plate assembly 18. Housing 16 extends through and below blackjack table 103. Mounting bracket 106 is attached to the underside of blackjack table 103. Mounting bracket 106 is basically comprised of 2 metal straps 108 (only one is visible) attached by hinge 110. Metal straps 108 are designed and arranged to grasp housing 16 by tightening of thumb screw 112 which draws together the two ends of metal straps 108 that are not hinged adjacent to hinge 110.

Figure 5:
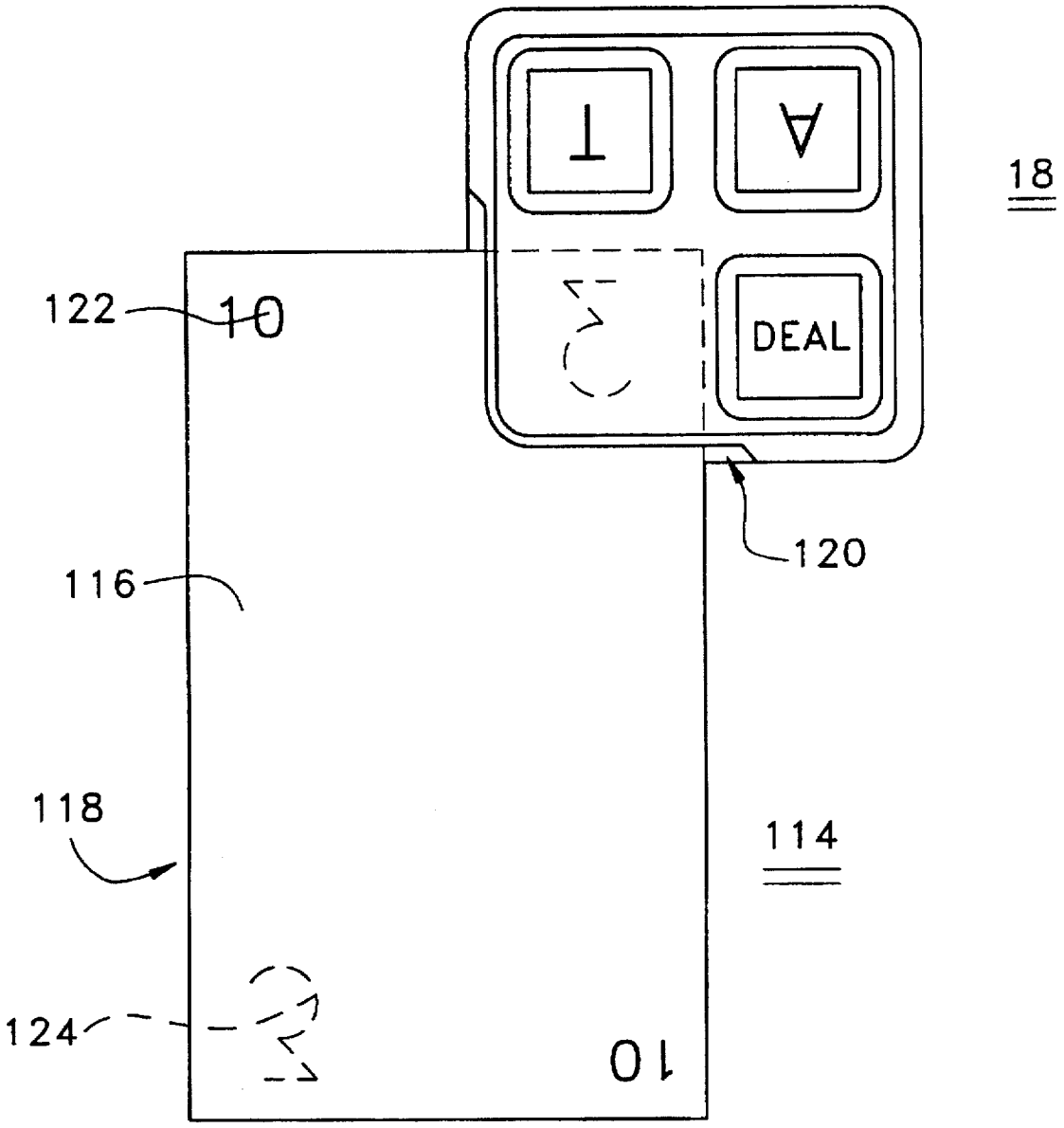
FIG. 5 shows a top view of the scanning module with playing cards positioned in the module.

FIG. 5 shows a Dealer's hand 114 being scanned by scanning module 10. Dealer's hand 114 is comprised of up-card 116, which is oriented face-up, with a character 122 of 10 and down-card 118, which is oriented face-down, with a character 124 of three. Character 124 is represented in dashed lines and the "3" is backwards because down-card 118 is oriented face-down requiring character 124 to be represented as if both cards are transparent. Up-card 116is positioned on top of and co-extensive with down-card 118. A corner of hand 114 is located in card insertion slot 120 of top plate assembly 18. Top plate assembly 18 is designed and arranged such that when hand 114 is positioned in card insertion slot 120, the character aligns with array module 52, allowing character 124 diagonal opposite to be scanned by array chip 100 (not shown).

Character 124 of down-card 118 is scanned by depressing "T" switch 28. "T" switch 28 is depressed because up-card 116 has a value of 10. "T" switch 28 would be depressed by the Dealer if the up-card is a 10, Jack, Queen, or King. If the up-card is an Ace, then "A" switch would be depressed by the Dealer. Depressing the switches informs the device of the value of the up-card. It is noted that only hands with up-card values of 10 through A may be scanned.

Figure 6:
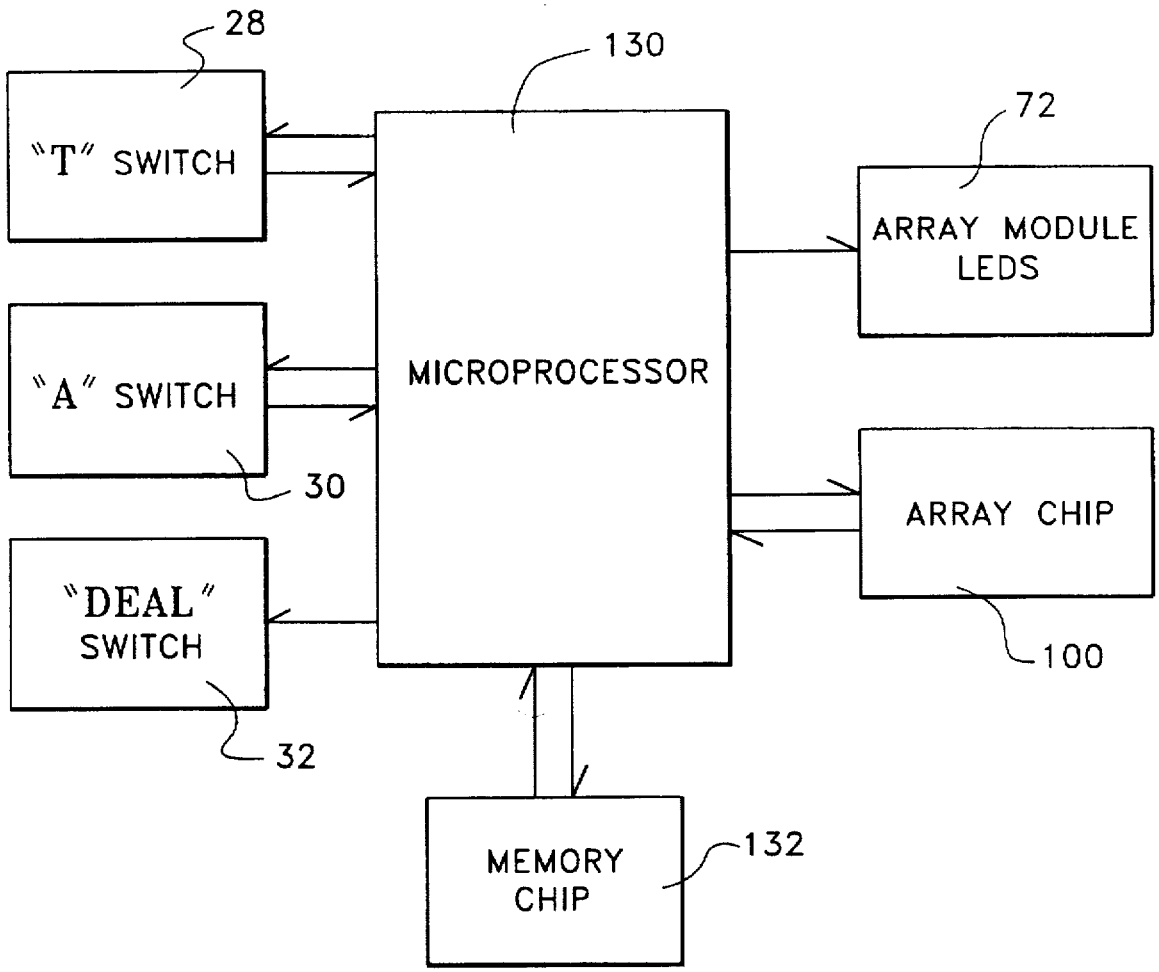
FIG. 6 is a schematic of the components of the scanning module which interact with the microprocessor.

FIG. 6 illustrates a simplified schematic of the components of scanning module 10 which interact with microprocessor chip 130 for scanning module 10 to perform its intended function. Microprocessor 130 receives input and provides output to "T" switch 28 and "A" switch 30 and provides output to "DEAL" switch 32. Microprocessor 130 also provides output to array module LEDs 72. Microprocessor chip 130 receives input and provides output to array chip 100 and memory storage chip 132. Memory storage chip 132 stores the references used to determine the character scanned by scanning module 10.

Figure 7:
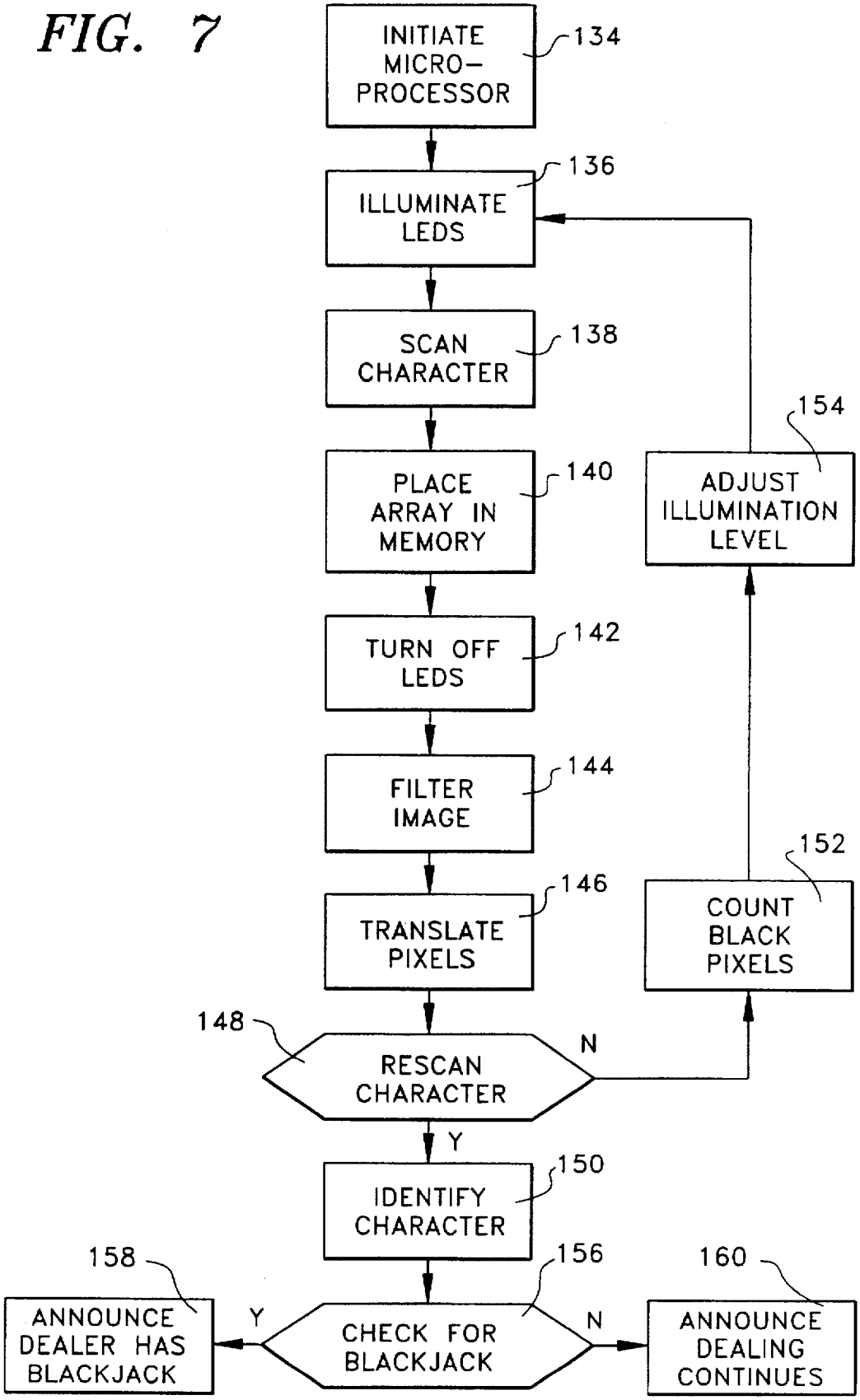
FIG. 7 is a flow chart of the steps of processing and announcing the results of scanning a playing card.

FIG. 7 illustrates the simplified routine the microprocessor carries out for analyzing the image and announcing the result. In block 134, microprocessor 130 is initiated by the Dealer depressing either "T" switch 28 or "A" switch 30. In other embodiments of the invention, not shown, microprocessor 130 can be initiated by foot pedals or other switch external to housing 16, verbal recognition, visual identification by a device, and more. The routine progresses to block 136 and illuminates array module LEDs 72 so character 124 can be scanned. Next, the routine progresses to block 138 and array module 100 scans character 124. In the preferred embodiment, scanning module 10 is configured and arranged to scan the entire character representing the value of a card, the characters being 2, 3, 4, 5, 6, 7, 8, 9, 10, J, Q, K, and A. However, in other embodiments of the invention (not shown), scanning module 10 could identify the value of a playing card by scanning only a portion of the character representing the value of card or by scanning middle area of the face of a playing card that displays symbol representing the value of the playing card. In the preferred embodiment, the array is comprised of black and white values, or pixels. Other embodiments of the invention include utilizing an array chip that translates the image of a character on a card into grey scale or color value pixels. The routine progresses to block 140 and microprocessor 130 retrieves scan data from array chip 100 and translates it into memory in the form of a stored pixel image. Next, the routine progresses to block 142 and turns off array module LEDs 72.

Next, the routine removes noise from the stored pixel image to counteract errors from heat, dust, ashes and lint from the casino environment. In block 144, the routine filters the stored pixel image array with a pixel mask. The filtering is accomplished removing the non-contiguous black pixels from the stored pixel image. In an alternative embodiment of the invention, the routine enlarges the stored pixel image by providing the image with an additional top and bottom row and a far right and far left column. Then the routine filters the enlarged pixel image with a "3×3" pixel mask. The filtering is accomplished by placing the mask over the nine pixels in the upper left corner of the array and counting the number of black pixels covered by the mask. If the number of black pixels is less than three, then the array element corresponding to the pixel in the center of the mask is assigned to be white. If the number of black pixels is greater than seven, then the array element corresponding to the pixel in the center of the mask is assigned to be black. This process continues through the array until the pixel mask has assigned black or white to every possible element in the array. The outer rows and columns drop out of the array as they cannot be assigned a value by the pixel mask, returning the array to its original size.

Next, the routine progresses to block 146 and the black pixels of the stored pixel image are translated to the upper left corner of the array while maintaining the relative positions of the black pixels in relation to each other. This translation is accomplished by shifting the field of the array one row up and/or one column to the left until the top row has any black pixels and the left column has at least two black pixels. Next, at block 148, the routine determines whether the stored pixel image can be identified or if the character needs to be re-scanned. If the number of white and black pixels are such that the character can be identified, then the routine progresses to block 150. If the routine cannot identify the character, the routine branches to block 152 and it counts the black pixels. If the number of black pixels is such that there are too many black pixels or too few black pixels to match any reference character in memory chip 132, the routine branches to block 154 where the illumination of the character is adjusted. If there are too many black pixels, the intensity of the light emitted by array module LEDs 72 is increased. If there are too few black pixels, the intensity of the light emitted by array module LEDs 72 is decreased. The routine then branches to block 136 to illuminate the character and re-scan it. Blocks 152 and 154 facilitate optimizing the level of illumination of the area of the character being scanned. In the preferred embodiment, the routine attempts to optimize the illumination twice. If, after two attempts at scanning the image, the character cannot be identified, the routine terminates with an alternating flashing of switch indicators to announce indeterminant character (not shown).

From block 150, the routine proceeds to block 156 and microprocessor 130 determines if the Dealer has blackjack. If "T" switch 28 was depressed in block 134, microprocessor 130 determines the Dealer has blackjack if the scanned character is an "A." If "A" switch 30 was depressed in block 134, microprocessor 130 determines the Dealer has blackjack if the scanned character is a "10," "J," "Q," or "K." In other words, microprocessor 130 determines if the Dealer has blackjack by combining the value of up-card 116 ("A" or "T") the Dealer has input into scanning module 10 when the Dealer depressed the switch in block 134 of the routine and the value of the character obtained in block 150 of the routine. If the Dealer depressed "T" switch 28 in block 134, the value associated with the switch is 10. If the Dealer depressed "A" switch 30 in block 134, the value associated with the switch is 11. In an alternative embodiment, the value of the up-card can be input by the Dealer using foot pedals or other switches external to housing 16, verbal recognition, visual identification by a device, and more; or by a device that recognizes the up-card as it rests on the blackjack table and inputs directly the identity of the card to microprocessor 130. The value of the two cards are combined if the value of Dealer's hand 114 totals twenty-one, the Dealer has blackjack.

Next, the routine branches to block 158 and announces whether the Dealer has blackjack. This is accomplished in the preferred embodiment by illuminating the switch associated with the value of down-card 118. For example, if up-card 116 is an ace and down-card 118 is a jack, the Dealer wins and microprocessor 130 illuminates the LED in "T" switch 28. In another ten and, if up-card 116 is a ten and down-card 118 is an ace, the Dealer wins and microprocessor 130 illuminates the LED in "A" switch 30. However, if Dealer's hand 114 is not blackjack, then the routine proceeds to block 160, where scanning module 10 announces that the dealing of the hand continues. This is accomplished in the preferred embodiment by microprocessor 130 illuminating the LED in "DEAL" switch 32. However, either or both announcing steps 158 and 160 can be accomplished by an audio announcement, a visual announcement, a combined audio and visual announcement, or by an electronic signal, to name a few other ways to announce the result. As is evident, some excitement among the players of blackjack can be generated using scanning module 10. The players can see the Dealer insert the cards into the module and press a switch, encouraging more player interaction by allowing the players to anticipate and root for "DEAL" switch 32 to be illuminated, signaling that the players still have a chance to win.

Preferably, a single type of casino grade playing cards should be used when using scanning module 10.

Figure 8:
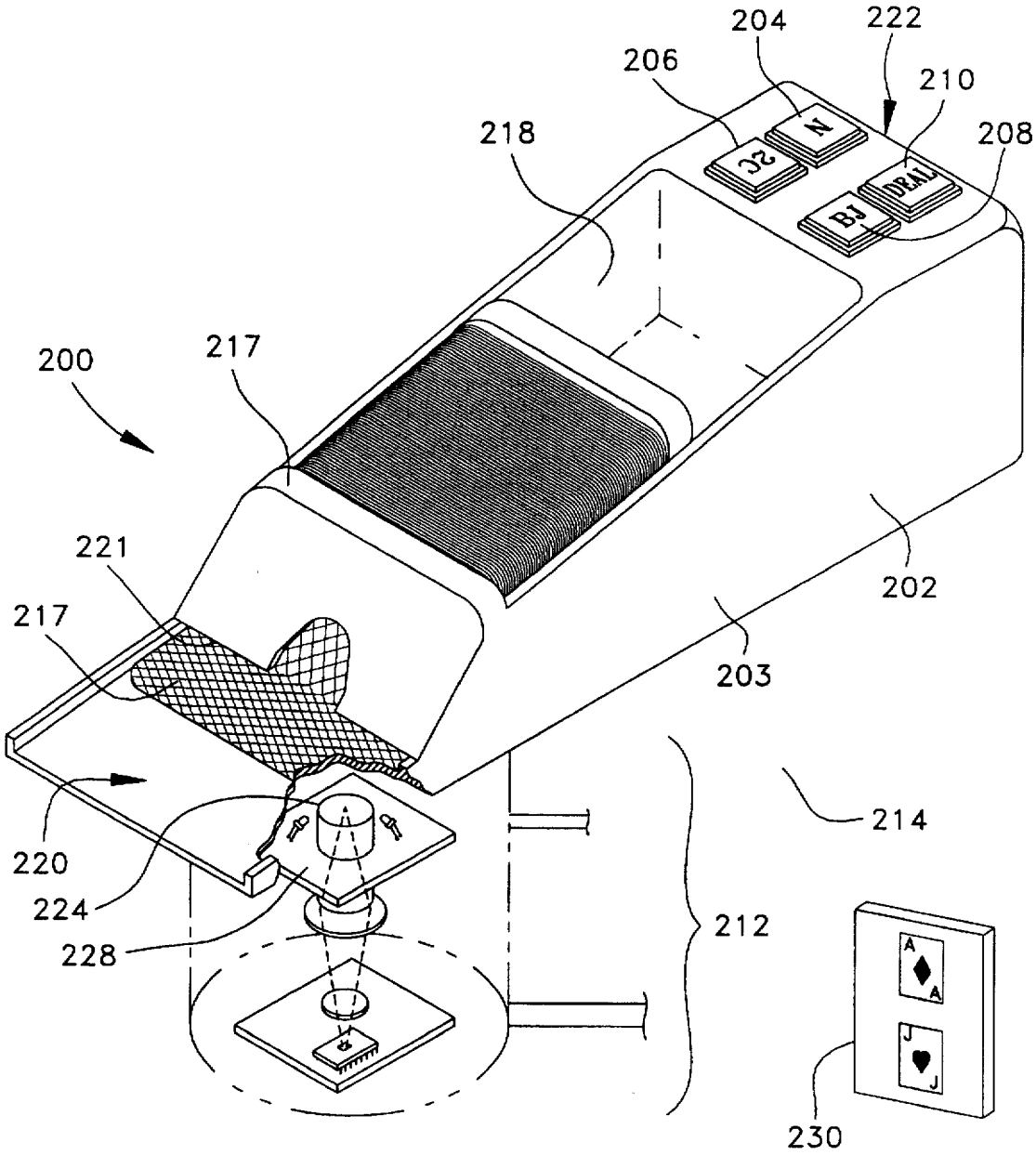
FIG. 8 is a planar view of another embodiment of a scanner module in accordance with the present invention.

Another embodiment of a card scanner in accordance with the present invention is shown in FIG. 8 as card scanner assembly 200. Card scanner assembly 200 may be programmed to determine how many players are initially in the game or how many players are in the game at any time, what each player's intial card values are or card values at any time, and whether the Dealer has blackjack. The card scanner assembly is shown mounted to a card playing table 214. Card scanner assembly 200 comprises a card shoe 202, a new hand start (N) switch 204, a second card deal (2C) switch 206, a black jack (BJ) indicating switch 208, a "DEAL" switch 210, and a scanning module 212 coupled to a central computer system (not shown).

The card shoe 202 is formed to hold several decks of playing cards 217 that will be used during the card game, and house the switches 204, 206, 208, and 210. The card shoe 202 may be movably mounted to a card table 214 so that the Dealer can swivel the card shoe 202 around the scanner to the most comfortable operating position. The card shoe 202 has sidewalls 203 which define a card compartment 218 for retaining the playing cards, an outlet end 220 through which cards are drawn from the card compartment 218, and a switch chamber 222 for retaining the switches 204, 206, 208 and 210. The outlet end 220 defines an aperture 224 that is aligned with the scanning module 212 so that the scanning module 212 can read each card 217 as each card 217 is removed from the card compartment 218 through the outlet opening 221.

The components of scanning module 212 interact with microprocessor chip 130. Microprocessor 130 receives input from the "N" switch 204 and "2C" switch 206 and provides output to the "BJ" switch 208 and "DEAL" switch 210. Microprocessor 130 also provides output to array module LEDs 72. Microprocessor chip 130 receives input and provides output to array chip 100 and memory storage chip 132. Memory storage chip 132 stores the references used to determine the character scanned by scanning module 212.

Although the scanning module 212 is provided to perform the same functions as the scanning module 10 described above, scanning module 212 has a modified physical structure than the scanning module 10 discussed above. One of the differences between scanning module 212 and scanning module 10 is that modified scanning module 212 has a different top portion 228. The top portion 228 of the scanning module 212 is substantially planar and transparent so that each card can be scanned as each card is removed from the card compartment 218. Additionally, none of the switches 204, 206, 208, 210 are mounted within the top portion 228.

The scanning module 212 is mounted below the card table 214. The top portion 228 is aligned with the aperture 224 within the card shoe 202 so that each card can be scanned as they are removed from the card compartment 218. Each switch 204, 206, 208, 210 is electrically coupled to the switch circuit holder 36 (not shown). Alternately, the switch compartment may be contained separately and apart from the card shoe 202, and electrically coupled to the switch circuit holder 36.

It is noted that with the switches 204, 206, 208, and 210 mounted apart from the scanning module 212, the scanning module 212 may be stored or housed more securely to prevent shredded paper, dust particles, or other foreign material from entering the scanner and damaging the sensitive optic components.

Each of the switches 204, 206, 208, 210 is provided for a different purpose. For instance, the "N" switch 204 is provided to indicate the start of a new blackjack hand and to activate the computer scanning function. The "2C" switch 206 is provided to indicate to the computer that the first two cards have been dealt to each player. The "2C" switch allows the computer to determine how many players are in the game, what each player's card values are, and whether the Dealer has blackjack. The "BJ" switch 208 is provided to indicate that the Dealer has blackjack. The "BJ" switch 208 is illuminated by a LED (not shown) within the switch 208 when the Dealer has blackjack. Additionally, a visual display 230 may be provided to visually indicate the value of the winner's card, whether the winner is the Dealer or any of the other players. The visual display 230 may be electrically coupled to the scanner assembly 200 or the card table such that the card value may be observed. If the Dealer does not have blackjack, then the "DEAL" switch 210 is illuminated by a LED (not shown) within the Deal switch 210 to indicate that the hand is to continue.

The operation of the card shoe assembly 200 will now be described. The Dealer presses the "N" switch 204 at the beginning of each new blackjack hand to activate the scanner module 212. The Dealer withdraws each card from the card holder outlet end 220 with the face of each card passing over the scanner top 228 so each card is scanned. After each players first two cards have been scanned, the Dealer depresses the "2C" switch 206 if the Dealer's up-card is an ace or is a card with a value of 10. If after the "2C" switch 206 is depressed and the Dealer's down-card is an ace, 10, J, Q, or K, then the Dealer has blackjack and the scanning module 212 illuminates the LED in the "BJ"

switch 208. Additionally, after the "2C" switch is depressed, the computer determines the number of players in the game, and what each players card values are. If the Dealer does not have blackjack, then the scanning module 212 announces the continuation of the hand by illuminating the LED in "DEAL" switch 210.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A card scanning module for use with standard playing cards, said module enabling announcement of when a hand having a first standard playing card and a second are blackjack, wherein one of said standard playing cards is dealt face down, comprising:

a. a scanner adapted to scan at least a portion of a first symbol of one of said standard playing cards dealt face down, said scanner having an array which holds the result of said scan;

b. memory for storing a plurality of references representing respective symbols of said standard playing cards;

c. analyzing means for comparing and determining the symbol of said first standard playing card based on a comparison of said array and said references;

d. inputting means for capturing the identity of said second standard playing card;

e. announcing means for reporting when the hand having the first standard playing card and the second standard playing card comprise blackjack; and f. Dealer shoe, said Dealer shoe comprising sidewalls which define both a card compartment for retaining a plurality of standard playing cards and said announcing means.

2. The card scanning module of claim 1 wherein the Dealer shoe further includes an outlet end for allowing a standard playing card to be removed from the card compartment.

3. The card scanning module of claim 2, said scanner further comprising means for adjusting the illumination of the symbol being scanned.

4. The card scanning module of claim 1, further comprising a means for determining the number of players and the value of each player's cards.

5. The card scanning module of claim 1, wherein said analyzing means further comprises noise removal means for removing errors of the type generated by a casino-like atmosphere.

6. The card scanning module of claim 5, said Dealer shoe configured for being movably mounted to a blackjack table, whereby a standard playing card can be slid over said scanner.

7. The card scanning module of claim 1, wherein said inputting means comprises a set of switches manipulatable by hand.

8. The card scanning module of claim 1, wherein said announcing means comprises an audio device.

9. The card scanning module of claim 1, wherein said announcing means comprises a visual output device.

10. The card scanning module of claim 1, wherein said announcing means comprises an electronic signal.

11. Method of reading and deciphering the value of cards, said method comprising the steps of:

a. providing a playing card Dealer shoe, said Dealer shoe comprising sidewalls which define both a compartment for retaining a plurality of playing cards and an outlet end for allowing a card to be removed from the card compartment;

b. providing a switch electronics system, said switch electronics system comprising:

a computer system for receiving and storing information;

a start switch to activate the computer system at the beginning of a new game;

an indicating switch to inform the computer system that the desired number of cards has been dealt, thereby storing the number of players in the game and the value of each card; a winner switch to indicate when the Dealer has won the card game; and a continue switch when the Dealer has not won and the game continues;

c. providing a scanner system for scanning a playing card, said scanner system proximate with the outlet of the dealer shoe, said scanner system being coupled to the switch electronics system, said scanner system comprising an optical sensor and light source, said optical sensor coupled to said light source such that when the optical sensor is covered said light source is activated to scan a card and convert the scanned information into a computer language so that the computer can read and store the information;

d. providing at least one playing card in the Dealer shoe card compartment, each of said playing cards having a face side and a back side, said face side having a card value;

e. activating the start switch to indicate that a new game has begun;

f. dealing a playing card by removing said playing card from the dealer shoe and sliding said playing card face side past the outlet of the dealer shoe and across the scanner system to activate the scanner system optical sensor and light source such that the card value is converted into a computer language and stored in the computer system;

g. activating the indicating switch to inform the computer system that the desired number of cards has been dealt, thereby storing both the number of hands that have been dealt and the value of each card; and h. activating the winner switch when the Dealer has won the card game and activating the continue switch when the Dealer has not won and the game continue.

12. The method of claim 11, wherein said step of providing a scanner system further comprises:

providing a scanner system that removes errors from the playing environment.

13. The method of claim 11, wherein said step of providing a scanner systems further comprises:

providing a scanner system that adjusts the illumination of the symbol being scanned.

14. The method of claim 11, wherein said step of providing a card shoe further comprises:

providing a card shoe that is movably mounted to a blackjack table.

15. The card method of claim 11 wherein said step of providing a switch indicating system further comprises the step of:

providing a switch indicating system that audibly announces when the Dealer has won the card game.

16. The card method of claim 11 wherein said step of providing a switch indicating system further comprises the step of:

providing a switch indicating system that visually announces when the Dealer has won the card game.

17. The card method of claim 11 further comprising the step of:

providing a visual display for indicating the value of the Dealer's card.

18. The card method of claim 11 further comprising the step of:

providing a visual display for indicating the value of the winning player's cards.

* * * * *